US007363844B2

(12) United States Patent
Barton

(10) Patent No.: US 7,363,844 B2
(45) Date of Patent: Apr. 29, 2008

(54) REMOTELY OPERATED, UNDERWATER NON-DESTRUCTIVE ORDNANCE RECOVERY SYSTEM AND METHOD

(76) Inventor: James Barton, P.O. Box 14003, Norfolk, VA (US) 23518

( * ) Notice: Subject to any disclaimer, the term of this patent is extended or adjusted under 35 U.S.C. 154(b) by 88 days.

(21) Appl. No.: 11/376,508

(22) Filed: Mar. 15, 2006

(65) Prior Publication Data

US 2007/0214949 A1 Sep. 20, 2007

(51) Int. Cl.
*F42B 33/00* (2006.01)
*B63G 7/02* (2006.01)
*B63C 11/50* (2006.01)

(52) U.S. Cl. ..... 86/50; 405/191; 114/313

(58) Field of Classification Search ..... 86/50, 86/49, 1.1; 102/402, 411; 89/1.13; 405/191, 405/190; 114/313, 312, 326
See application file for complete search history.

(56) References Cited

U.S. PATENT DOCUMENTS 4,621,562 A * 11/1986 Carr et al. ..... 89/41.05
6,113,343 A * 9/2000 Goldenberg et al. ..... 414/729
6,377,872 B1 * 4/2002 Struckman ..... 700/258

FOREIGN PATENT DOCUMENTS

FR 2832975 A * 6/2003
GB 2234203 A * 1/1991

* cited by examiner

*Primary Examiner*—James S Bergin
(74) *Attorney, Agent, or Firm*—Goldizen & Associates; Bradley D. Goldizen

(57) ABSTRACT

A remote operated, underwater non-destructive ordnance recovery system, includes a powered remote controller, a floating remote controlled transceiver wired to a remote disposal unit having a hydraulic grapple, an ordnance recovery basket, and the method in which these devices are used to extract unexploded underwater ordnance. The remote disposal unit includes an electrically driven internal hydraulic pump with bio-degradable hydraulic fluid in a closed loop system. A base includes variable footplates to stabilize the hydraulic grapple by remotely adjustable telescoping legs. A control head that receives signals from control cables and transfers them into hydraulic value actuation, an extendable fully rotating boom, two ballast tubes, a rotating grapple, and lighted underwater cameras on the control box and ballast tubes are also included in remote disposal unit.

18 Claims, 18 Drawing Sheets

REMOTELY OPERATED, UNDERWATER NON-DESTRUCTIVE ORDNANCE RECOVERY SYSTEM AND METHOD

There are no related patent applications.

This application did not receive federal research and development funding.

BACKGROUND OF THE INVENTION

The present invention generally relates to a system and method which allows for the safe disposal of unexploded underwater ordnance, like bombs, projectiles and mines. More particularly, the invention relates to a remotely controlled system comprised of a remote controller, a floating transceiver including an antenna that receives remote control signals from the remote controller and provides control signals through a tether to an underwater hydraulic grapple, and an ordnance recovery basket. The floating transceiver further includes a power source such as a generator or battery set for providing power for operating the hydraulic grapple to retrieve ordnance from the bottom of a body of water.

"Knuckleboom" or hydraulic grapples are used commercially in the logging industry to load cut logs onto transportation devices such as trucks and railroad cars. Outside of the logging and construction industries, however, grapples are rarely used.

There are many offshore sites around the world that have served as dumping grounds for unexploded ordnance, such as mines, bombs, projectiles, and bulk containers holding chemical weapons filler material. At ammunition handling facilities where the draft of the vessel exceeds the working depth of the port, weapons must be unloaded at sea. Cargo handling mishaps result in the sea floor surrounding many ports being laden with undetonated bombs, creating both safety issues and environmental hazards.

Moreover, some coastal areas, open ocean, and inland bodies of waters have formerly been subjected to long term use as "live fire impact areas," for training and weapons development. This has resulted in high concentrations of unexploded ordnance in areas which are today sought for recreational use and commercial development.

The present invention incorporates for the first time the use of a remotely controlled grapple, capable of functioning underwater and directed via a remote controller, to dispose of submerged ordnance by first depositing it into a recovery basket to create a safe, non-explosive way of clearing an ocean floor of the explosives. The present invention also claims a method for disposing of unexploded underwater ordnance.

SUMMARY OF THE INVENTION

The invention, a remotely operated, underwater non-destructive ordnance recovery system, provides a new an unique way of removing underwater ordnance by utilizing a multi-part system operated by remote control. The system comprises a remote controller that is located remote from an underwater grappling unit. The grappling unit is deposited onto the bottom of a body of water in an area that is saturated with unexploded ordnance. An antenna platform floats on a surface of the water and may include a power source. The antenna receives control signals from the remote controller. These control signals cause a plurality of valves in the grappling unit to be opened or closed. Each valve directs a flow of fluid through an associated piston to extend, retract or cause the piston to assume a neutral operation. By extending and retracting the pistons, the grapple may be manipulated to grip unexploded ordnance. The unexploded ordnance is then raised to the surface of the water.

The system contains a remote controller having a first plurality of switches that produce control signals which are wirelessly transmitted to a remote antenna to cause the grappling unit to be leveled. A second plurality of switches controls movements of a boom to raise and lower a base boom element and an end boom element to cause a grapple attached at an end of the end boom element to be extended away from the grapple unit. A further switch causes the boom to rotate relative to the outriggers attached to a base of the grapple unit. A third plurality of switches produce control signals that manipulate the jaws of the grapple to open, close, rotate and lock. A fourth keyed locking switch control operation of the remote controller. The remote controller includes an antennae capable of sending the remote controlled signals a minimum distance of 600 feet. Monitors display a remote video feed from cameras located on the grapple unit.

The system also contains a floating transceiver comprised antennae for receiving signals from the remote controller, a power source, and a control head. The control head includes a decoder for decoding the control signals transmitted from the remote controller. The decoded control signals are routed to pulse width modulators to produce signals that control the flow of fluid through the pistons. The control head converts electronic signals from the remote controller into the actuation of hydraulic valves in a closed loop hydraulic system driven by an internal electrically powered pump, thereby controlling the motion of the knuckleboom. Located on both the control box and on either side of the ballast tubes are lighted underwater cameras which transmit images to the control station.

Tethered to the transceiver by a control cable is the grappling unit. The grappling unit is typically capable of moving ordnance from 500-2000 lbs., depending on the length of extension of the boom. The grappling unit comprises a base stabilized by three or four remotely adjustable legs. The adjustable legs act as outriggers that may be manipulated to maintain the base in a level manner or at a desired angle. Feet attached to the adjustable legs contact the bottom of the body of water. The feet may be of various sizes and shapes and are readily removable and replaceable for accommodating different bottom surfaces. The control head receives signals via the control cable and transfers those signals into hydraulic value actuation to manipulate the jaws arranged at the end of the boom. The end boom element includes two ballast tubes which stabilize the unit at maximum extension. Typically the grapple jaws are capable of picking ordnance having a diameter of no less than three inches and no larger than forty-eight inches. Located on both the control box and on either side of the ballast tubes are lighted underwater cameras which transmit images to the control station. The grapple motion is powered by an electrically driven internal hydraulic pump which circulates a bio-degradable hydraulic fluid, such as vegetable oil, through a closed loop system.

The system contains a submergible ordnance recovery basket defining an cavity capable of holding unexploded ordnance. This recovery basket comprises wire mesh sides and top and includes a rigid floatation cylinder that includes an input port for receiving pressurized air and a pressure relief valve for controlling ascent of the recovery basket when raising it to the water surface. The basket is tethered to a surface buoy by a fixed bail attached to the basket. The lower portion of the basket, the receptacle, has a spring loaded entry door for ordnance on one side and a hinged prop door on the other side. The upper portion of the basket, the cylinder, has, on the spring loaded entry door side, attached self locking latches and an armor kick plate for deflecting ordnance downward when it enters the receptacle. On both sides of the basket are located compressed air cylinders which release air through a connective tube into the cylinder to raise the basket to the surface. So that the basket raises at a steady speed, pre-set, automatic pressure relief valves are located on both sides of the cylinder. Pre-set sonic valves are located on each connective tube to allow a set amount of air to be released from the cylinder uniformly to rises the basket at a steady speed. One door is for depositing ordnance in the recovery basket; the other door is located on an opposite side and is opened to allow the ordnance to be dropped from the recovery basket. Compressed air is stored in storage tanks on either side of the recovery basket and includes remotely actuated valves such sonic valves for releasing air from the storage tanks and directing it into the rigid floatation cylinder. Self locking latches are provided for securing the loading door.

An object of the invention is to enable the user to safely move underwater unexploded ordnance from the seafloor to a location where it can be safely stored or detonated with as little harm to the environment and wildlife as possible.

A further object of the invention is to enable the user to safely clear large areas of underwater unexploded ordnance from a bottom of a body of water.

A further object of the invention is to enable the user to safely move underwater unexploded ordnance from the seafloor without the assistance of a human diver.

Additional objects and advantages of the invention will be set forth in part in the description which follows, and in part will be obvious from the description, or may be learned from practicing the invention. The objects and advantages of the invention will be obtained by means of instrumentalities in combinations particularly pointed out in the appended claims.

DETAILED DESCRIPTION OF THE INVENTION

Figure 1:
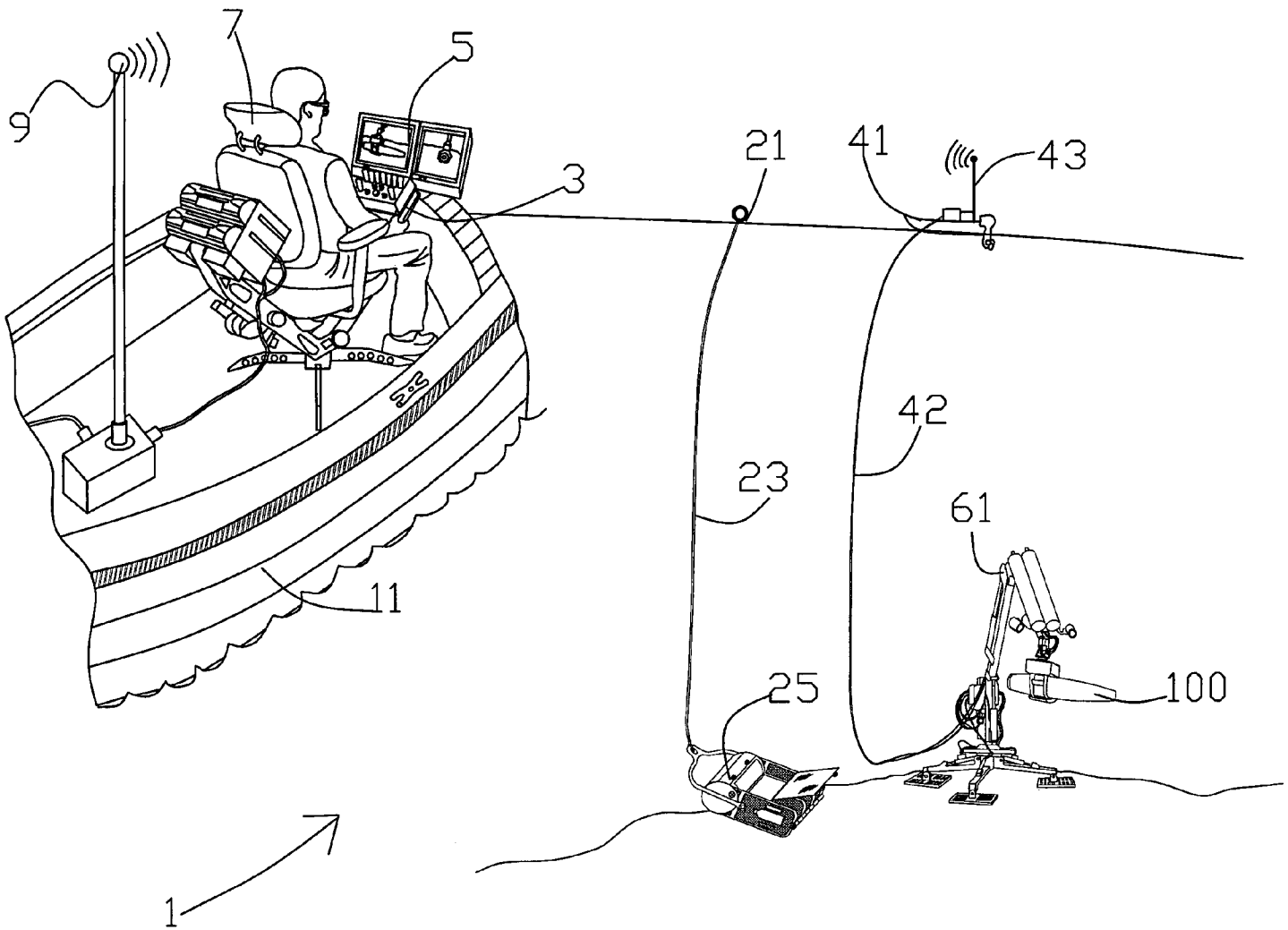
FIG. 1 is a perspective view of a first embodiment of an underwater, unexploded ordnance removal system.
Figure 3:
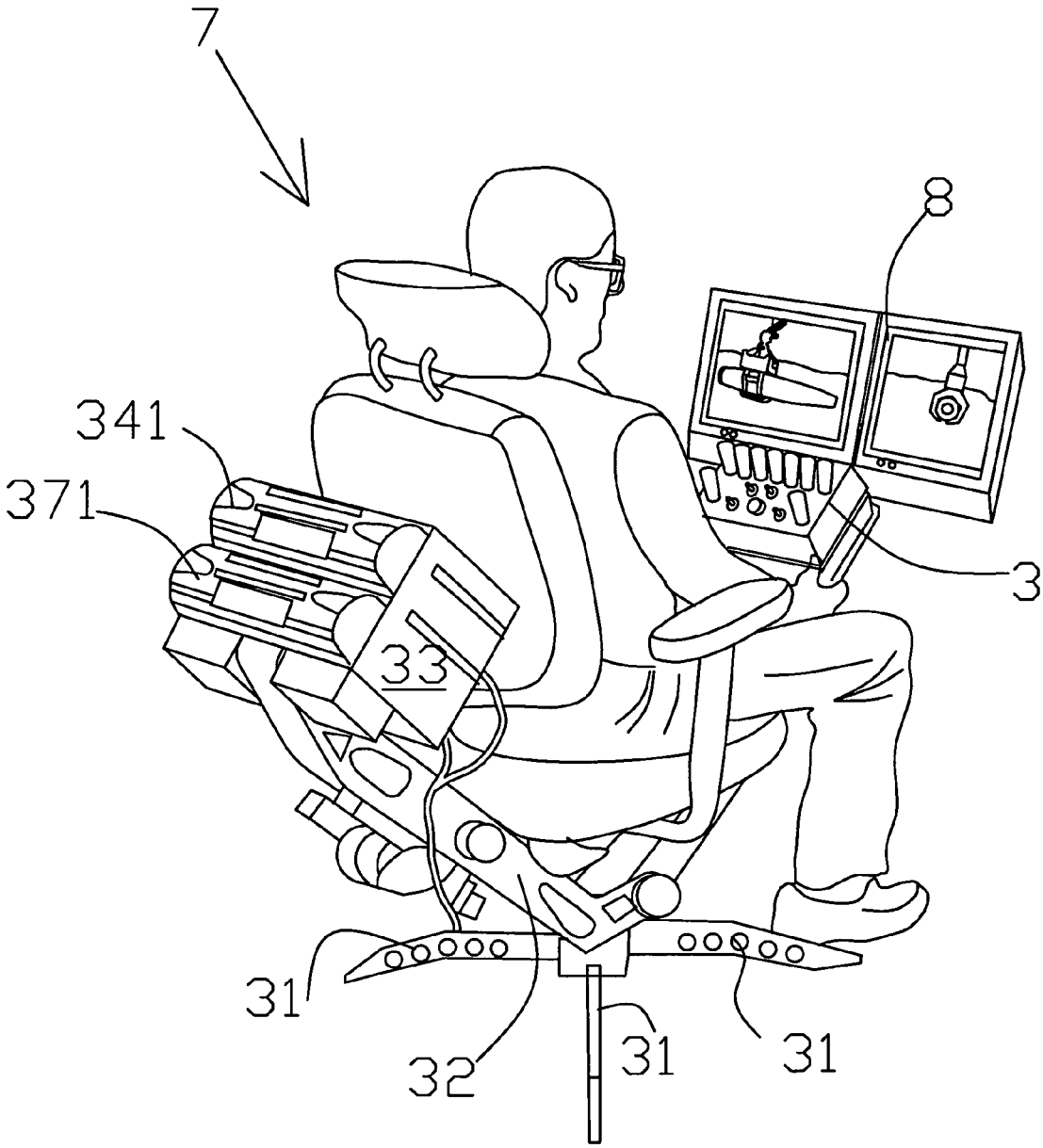
FIG. 3 is an enlarged view of a control station shown in FIG. 1.

The preferred embodiment is shown in FIG. 1. The system 1 includes an operator station 7 that is remote from an ordnance disposal unit 61. An enlarged view of the operator station is shown in FIG. 3 and includes a display 5 that comprises a receiver and displays video feeds from lighted cameras on the disposal unit 61. A remote controller 3 is arranged in easy reach of an operator. In FIG. 1, the operator station is arranged in a boat 11. An antenna 9 receives control signals from the remote controller 3 and transmits these signals to the floating transceiver 41 which comprises a second antenna 43. These signals are relayed from the floating transceiver 41 to the disposal unit 61 via cable 42. In this manner, the operator may view the display 5 and manipulate the remote controller 3 to cause the disposal unit 61 to grip ordnance 100 and lift it from a sea floor or lake bottom. The disposal unit 61 thereafter rotates to swing the ordnance 100 and deposit it into a basket 25. The basket 25 is coupled to a float 21 via retrieval cable 23. The float 21 may be pulled to a designated area where the basket 25 may be emptied.

Figure 2A:
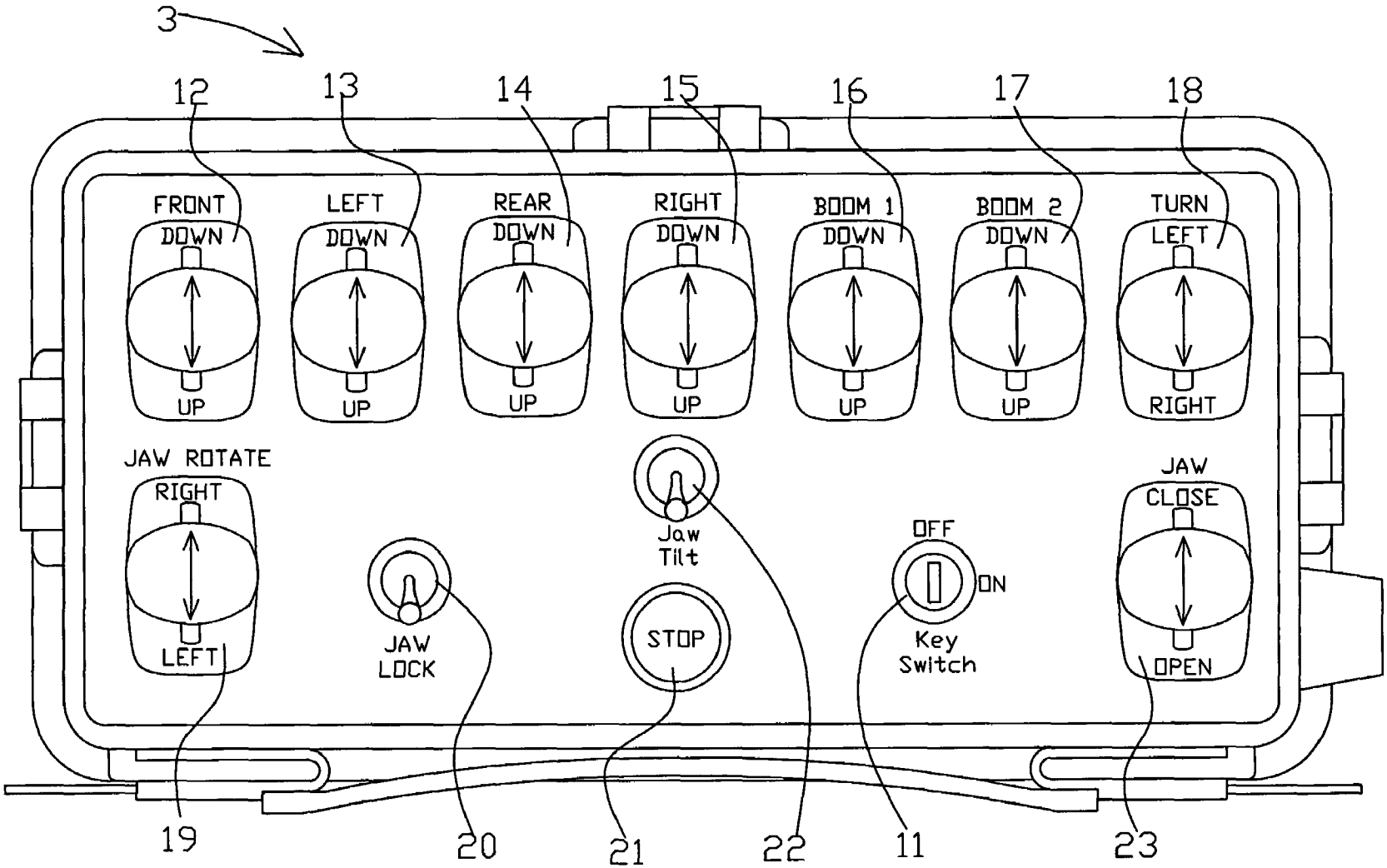
FIG. 2A is a plan view of a remote controller reflecting the various switches that control a remote underwater, unexploded ordnance removal grapple mechanism.

FIG. 2A is a plan view of the remote controller 3 that comprise a plurality of switches 11-23. A first plurality of switches 12-15 create control signals that extend and retract legs 66 to level disposal unit 61. These switches are neutrally biased toggle switches that may be force in opposite directions to create control signals. Switches 12 and 14 control the respective operation of a front and rear leg for raising the respective areas of the base. Switches 13 and 15 control the respective operation of left and right legs in the same manner to level the base of the disposal unit 61.

The remote controller 3 comprises a second plurality of switches 16-18 which are also neutrally biased toggle switches that may be forced into a opposite directions to control the various operations of the boom. Switch 16 raises and lowers a base boom element that is coupled to the base of the disposal unit 61. Switch 17 raises and lowers an end boom element that is coupled to the base boom element on one end and to a grapple at the other end. Switch 18 rotates the boom relative to the base.

A third plurality of switches 19, 20, 22 and 23 control the operation of the jaws that comprise the grapple. Switch 19 rotates the jaws relative to the end boom element. Switch 22 tilts the jaws relative to the end boom element. Switch 23 provides control signals that cause the jaws to be opened or closed. When engaged, switch 20 locks the jaws after they grip the ordnance 100 to prevent an inadvertent dropping of them.

The remote controller 3 is also equipped with a key lock 11 similar to an automobile ignition switch that prevents unauthorized use of the disposal unit. A key (not shown) must be inserted into the key lock 11 and the key lock twisted to allow power to flow from a power source (shown in FIG. 2B) to the remote controller in order for the remote controller 3 to be operated. Without the key, operation of the remote controller 3 is prohibited. An emergency stop switch 21 quickly shuts down the disposal unit if an emergency condition arises.

Figure 2B:
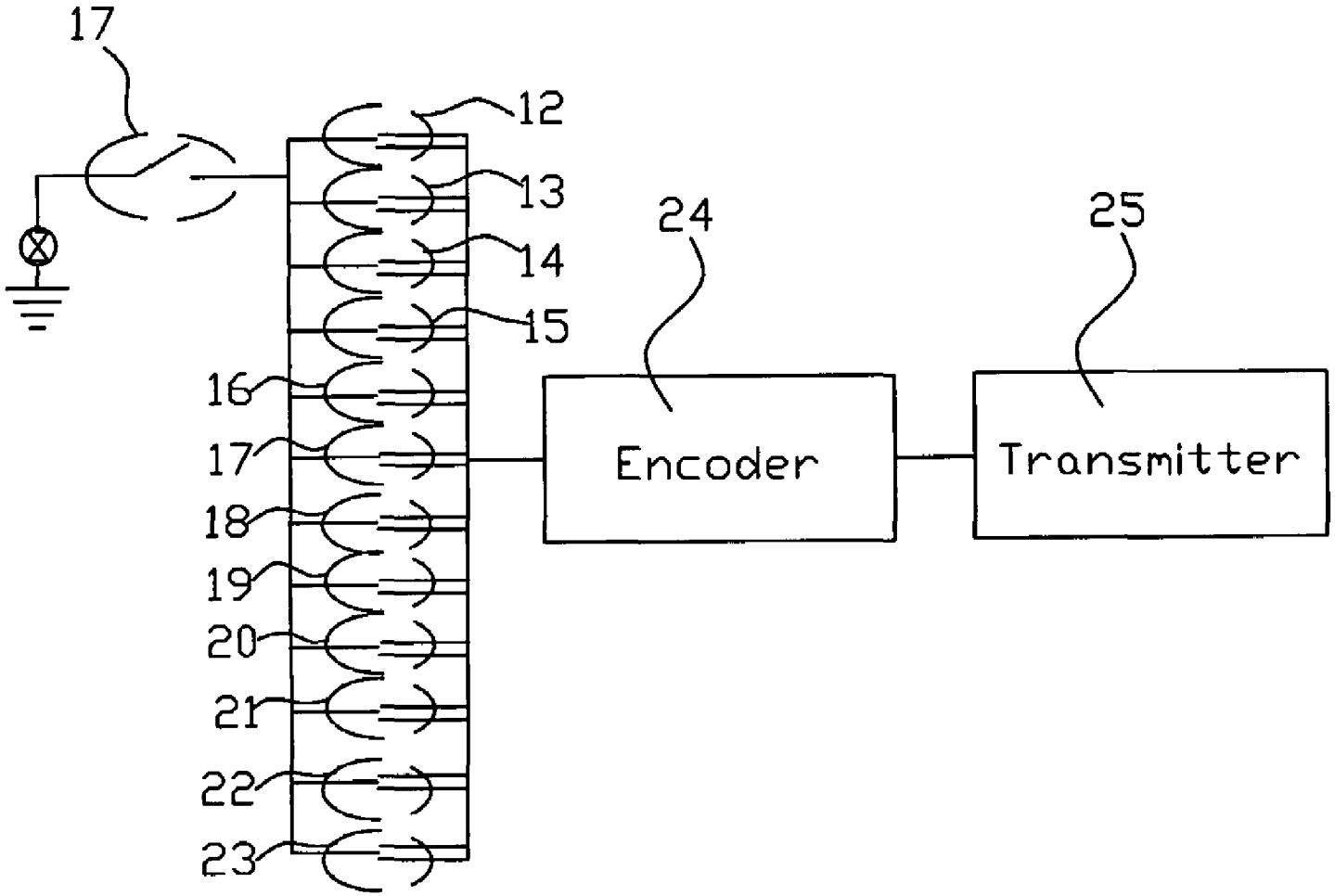
FIG. 2B is a schematic view of the remote controller.

FIG. 2B is a simplified schematic of the remote controller 3. A power source 30 is coupled to the 11. Without first turning key switch 11 on, the remote controller cannot produce control signals to be relayed to the remote disposal unit 61. The switches 12-23 are prohibited from operating when the key switch is in an off position. Each switch is connected to an encoder for producing a control signal associated with a respective valve on the disposal unit 61. These signals are then routed to a transmitter and transmitted via antenna 9.

FIG. 3 is an enlarged view of operator station 7 shown in FIG. 1. The operator station 7 comprises a chair 30 that includes a plurality of legs 31 arranged beneath the chair 30. An arm 32 extends from the chair 7 and includes a rack 33 for accommodating data storage devices 34 for recording the video signal shown on display 5.

Figure 4A:
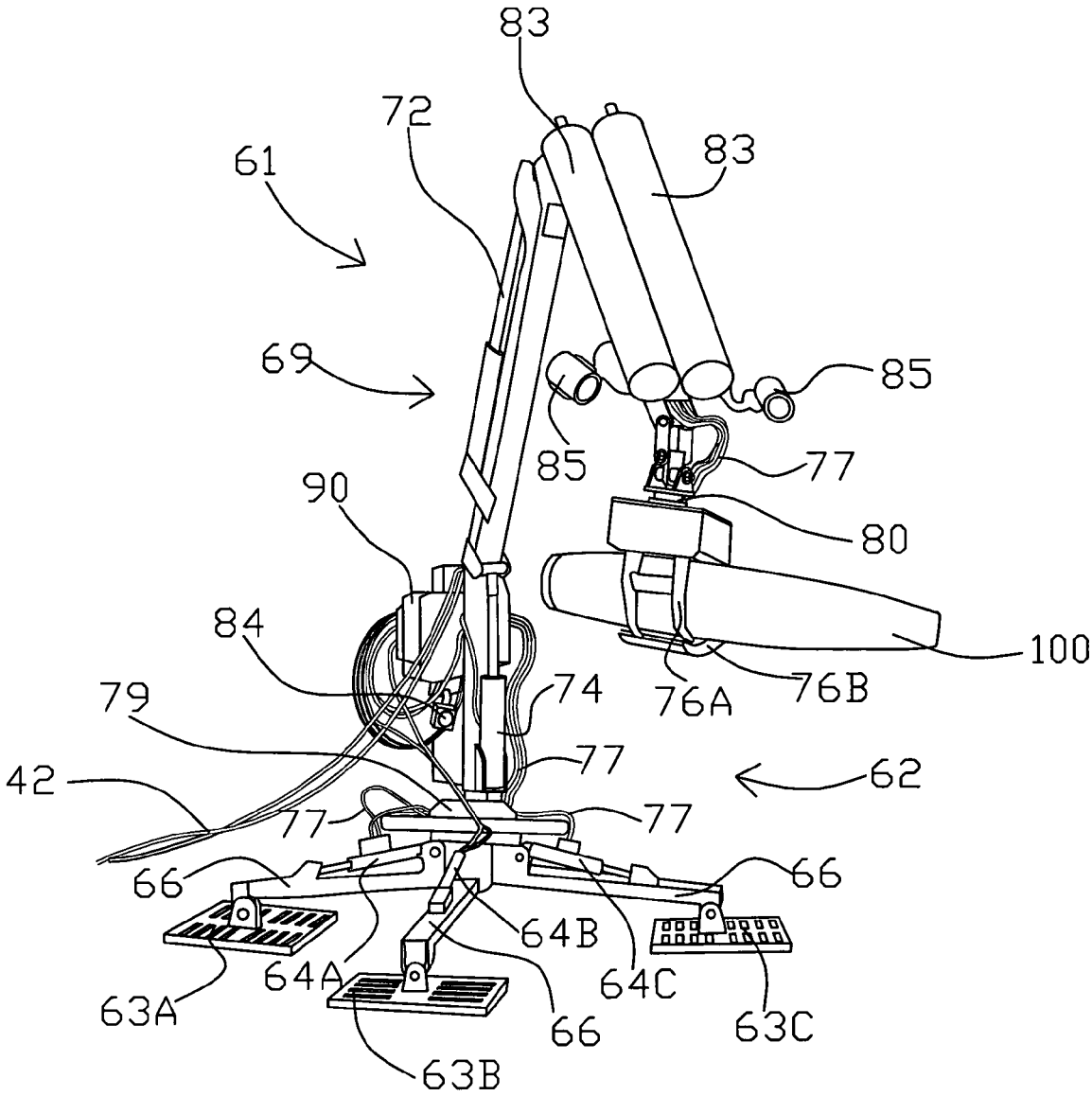
FIG. 4A is first perspective view of the remote underwater, unexploded ordnance removal grapple mechanism.
Figure 4B:
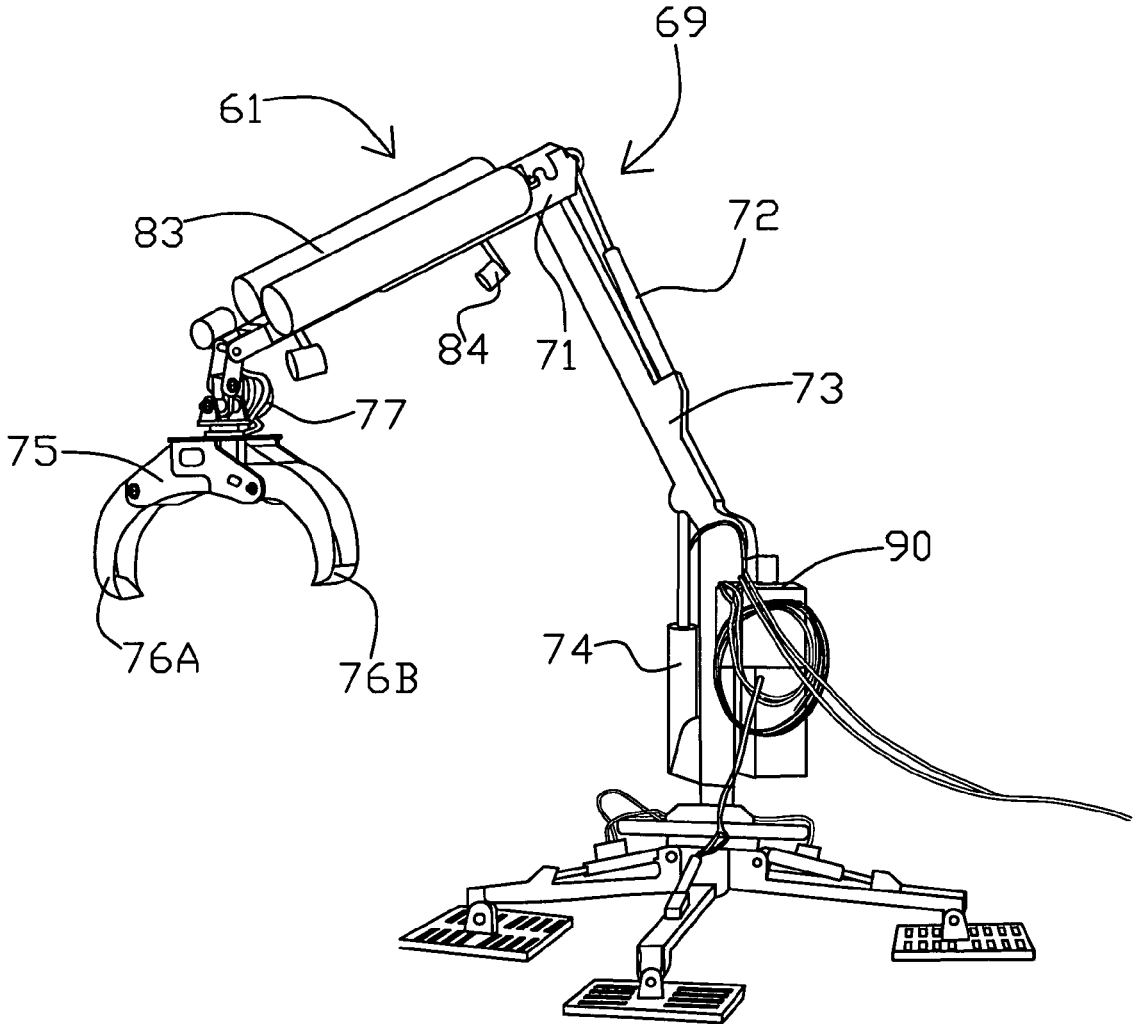
FIG. 4B is a second perspective view of the remote underwater, unexploded ordnance removal grapple mechanism.

FIGS. 4A and 4B are different perspective views of the remote controlled disposal unit 61. For ease in understanding the invention, all hydraulic lines or hoses that transport fluid from the control head to the pistons are labeled as 77. It should be noted that the bi-directional valves used in the present invention allow for the fluid to flow a direction from the pump to the piston and from the piston back to the reservoir from which the pump draws a source of fluid. Likewise, the piston may be arranged to have a hydraulic line entering opposite ends to drive the piston towards either an extended or retracted position.

The remote disposal unit 61 includes a boom 69 that comprises a base boom element 73 and an end boom element 71. One end of the base boom element 73 rotateably connects to the base 62. The base 62 includes a control head 90 to which one end of hydraulic lines 77 connect thereto. An opposite end of each hydraulic line 77 connects to a respective piston. A foot 63 attaches at each free end of each retractable leg 66. The pistons 64 may be extended or retracted to cause the lowering and raising of their respective leg. Since the feet are settled on the bottom, this movement in turn is transmitted to the base 62. Control signals produced by switches 12-15 of remote controller 3 control the position of various valves in the control head 90 to cause the extension and retraction of respective legs 66.

As previously mentioned, the base 62 includes a rotation element 79 that allows the boom 69 to swing a grapple 55 in an arc relative to the legs 66. This rotation element works similar to the pistons in that fluid may be forced into the rotation element 79 in a first direction to swing the boom 69 and grapple 55 counterclockwise. When fluid is forced into the rotation element 79 in an opposite direction, the boom 69 and grapple 55 spin clockwise about the base 62. The direction of the flow of fluid is controlled by switch 18 shown in FIG. 2A.

The boom 69 attaches above the rotation element 79 and comprises a base boom element 73 and an end boom element 71 to which grapple 55 attaches. A piston 74 causes a free end of the base boom element 73 to be raised and lowered. This free end is pivotally coupled to one end of the end boom element 71. A piston 72 attaches between the base boom element 73 and the end boom element 71 to cause the end boom element 71 to be rotated about the free end of the base boom element 73. Hydraulic hoses 77 connect to each of the pistons 73, 74 and pressure in each is controlled by a valve located in the control head 90 and being controlled by the associated switches 16, 17.

A pair of ballasts 83 are arranged atop the end boom element 71 to assist in stabilizing the disposal unit 61 when it is operating at with the boom at maximum extension. A camera 84 is coupled to the base unit 62, as shown. Two lighted cameras 85 are arranged along the end boom element 71 and wirelessly transmit a real time video signal back to the display 5. Jaws 76A and 76B grip ordnance 100 in FIG. 4A.

Figure 4C:
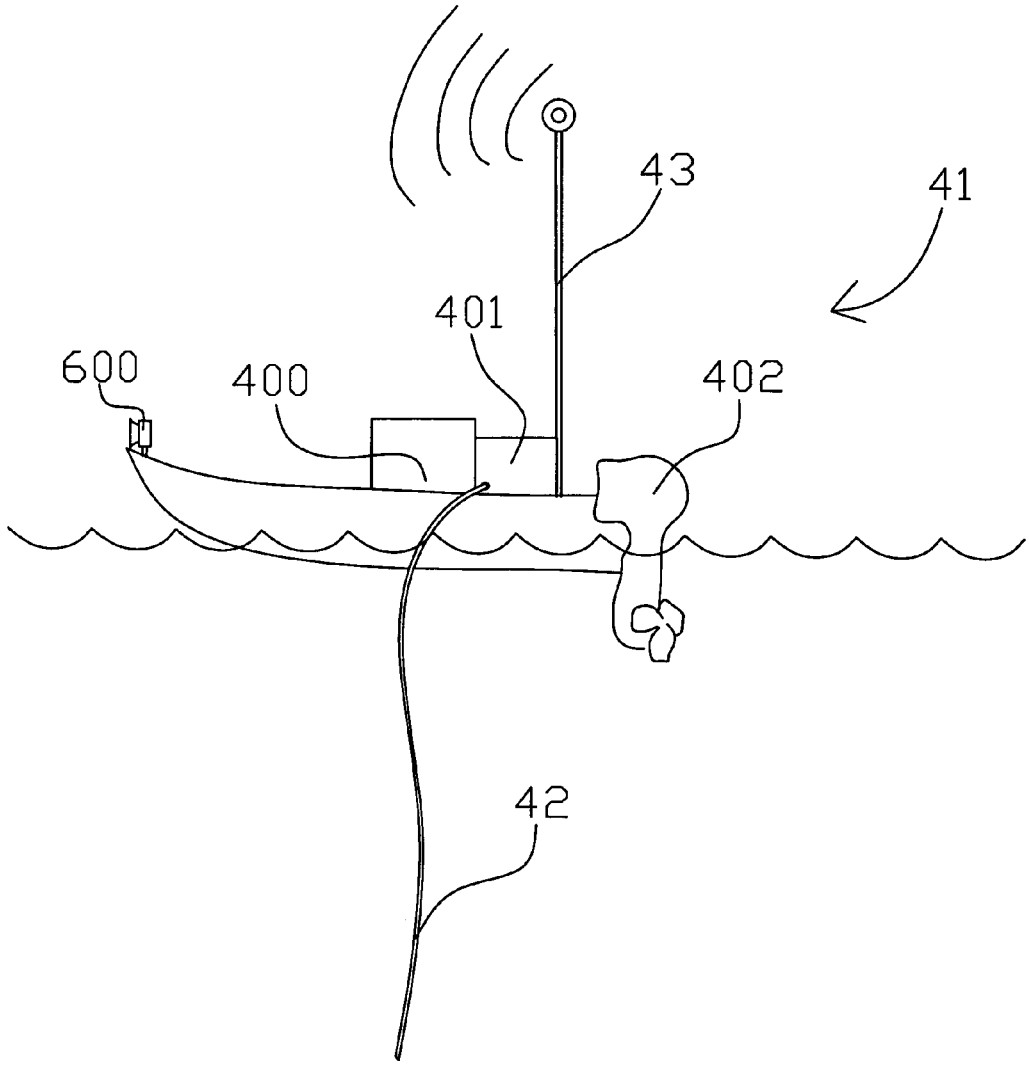
FIG. 4C is a perspective view of the floating antenna and power supply.

FIG. 4C is a perspective view of a floating transceiver that includes a horn 600 informing others when the system is in operation. The floating transceiver includes a generator for supplying power to the remote disposal unit 61. A receiver repeater box 401 receives signals from remote controller 3 and relays them to the control box 90. Engine 402 propels the floating transceiver 41 to a remote location where the ordnance is located.

Figure 5:
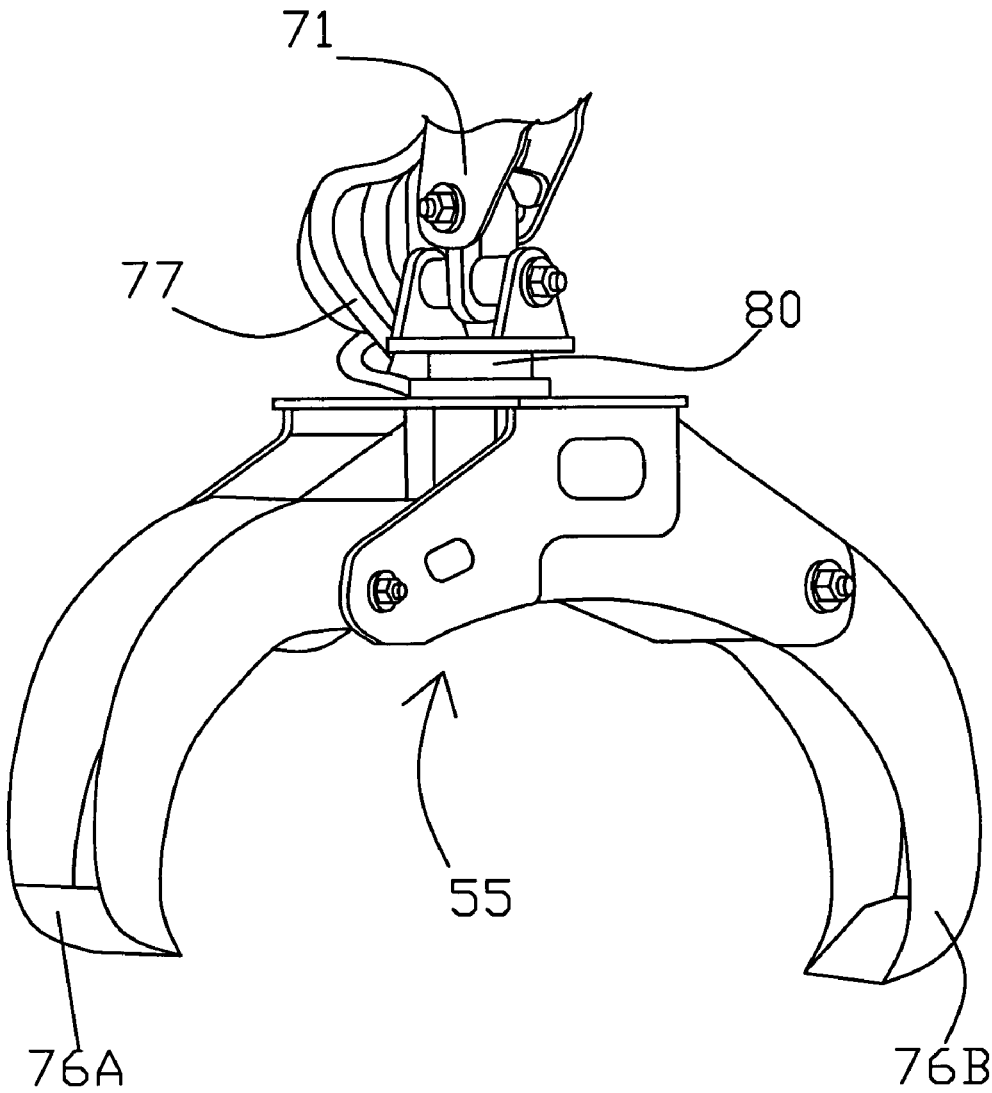
FIG. 5 is a close up perspective view of the grapple.
Figure 6A:
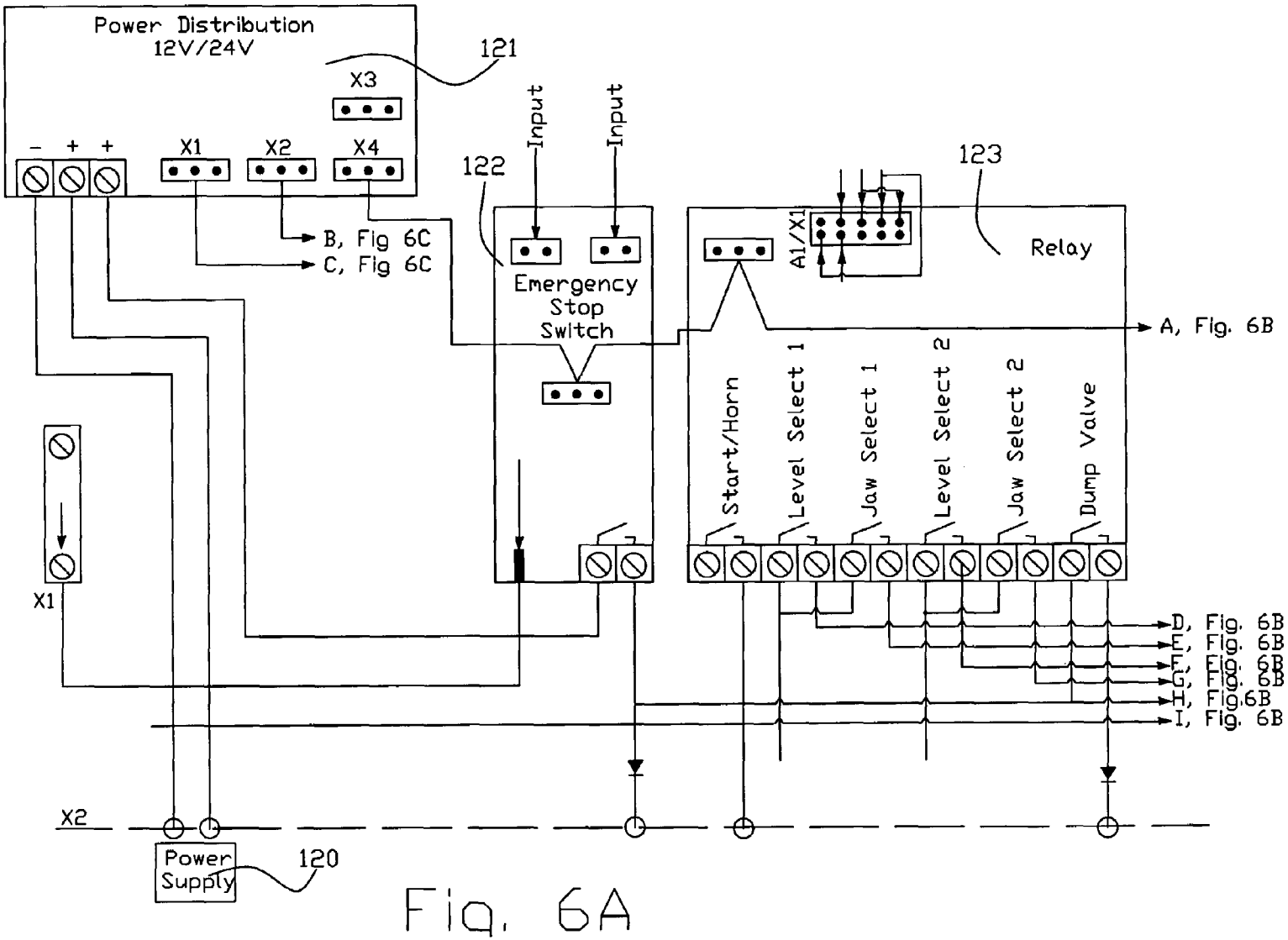
FIGS. 6A-6D show schematic views of the control unit attached to the remote underwater, unexploded ordnance removal grapple mechanism.
Figure 6B:
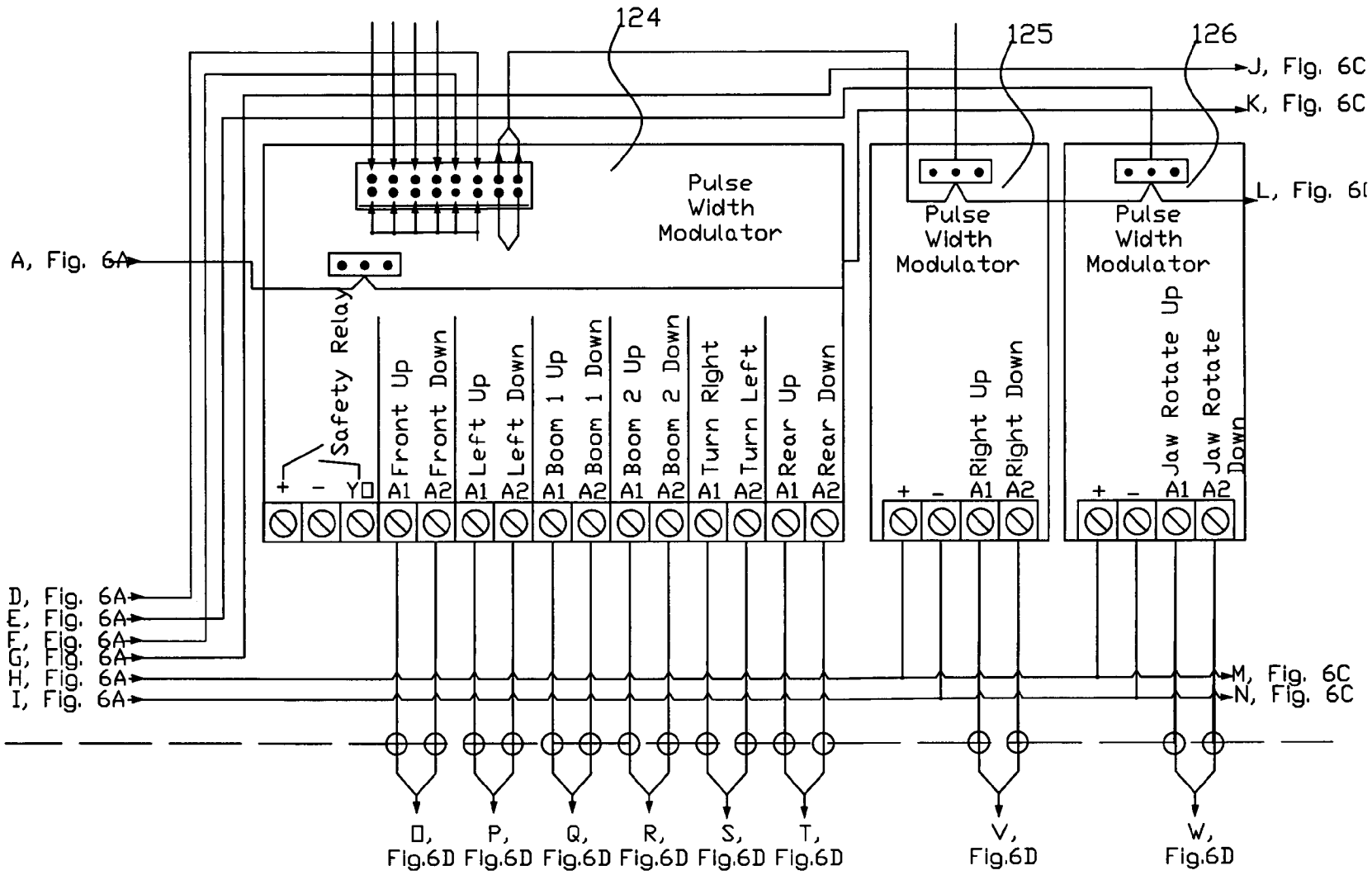
Figure 6C:
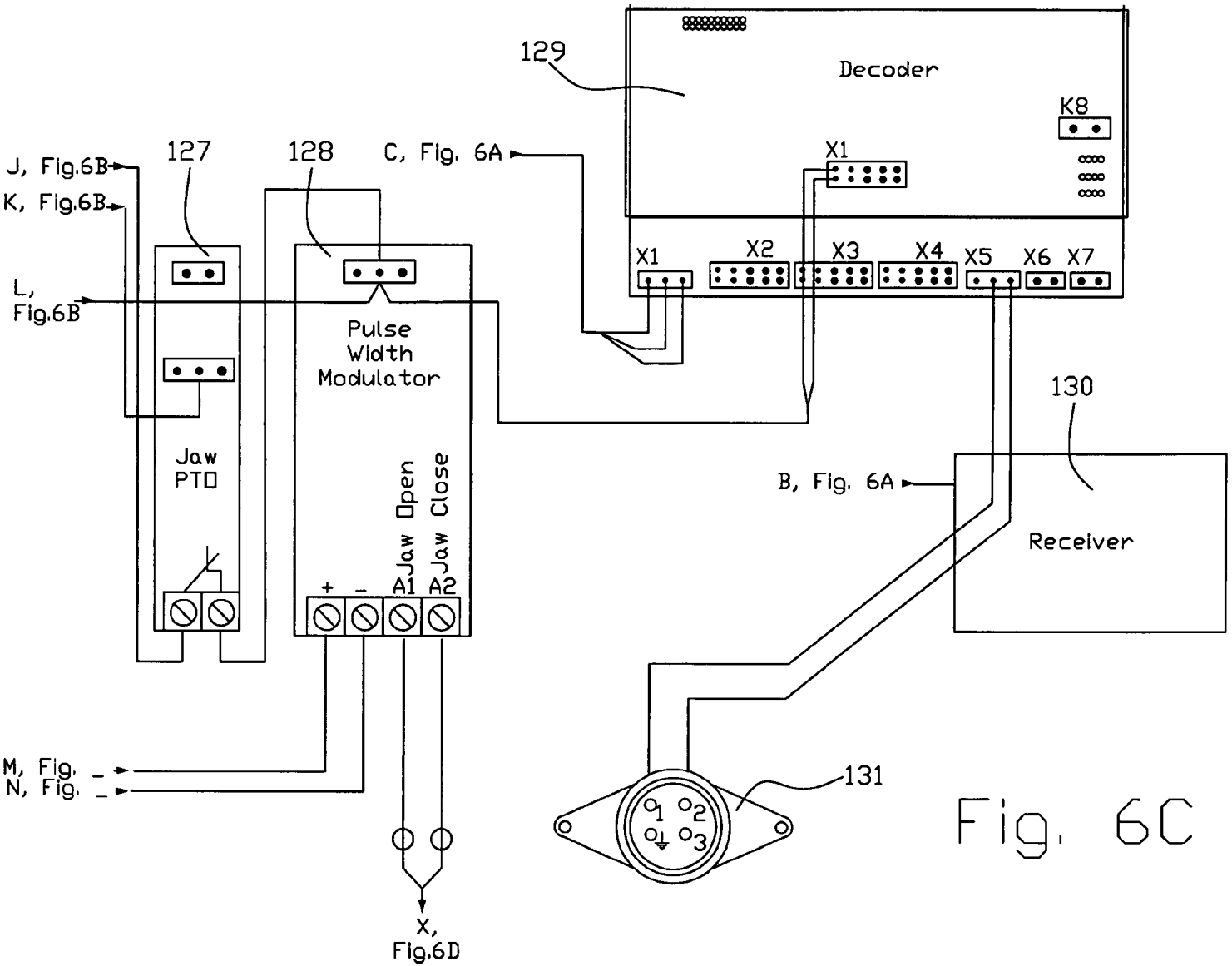
Figure 6D:
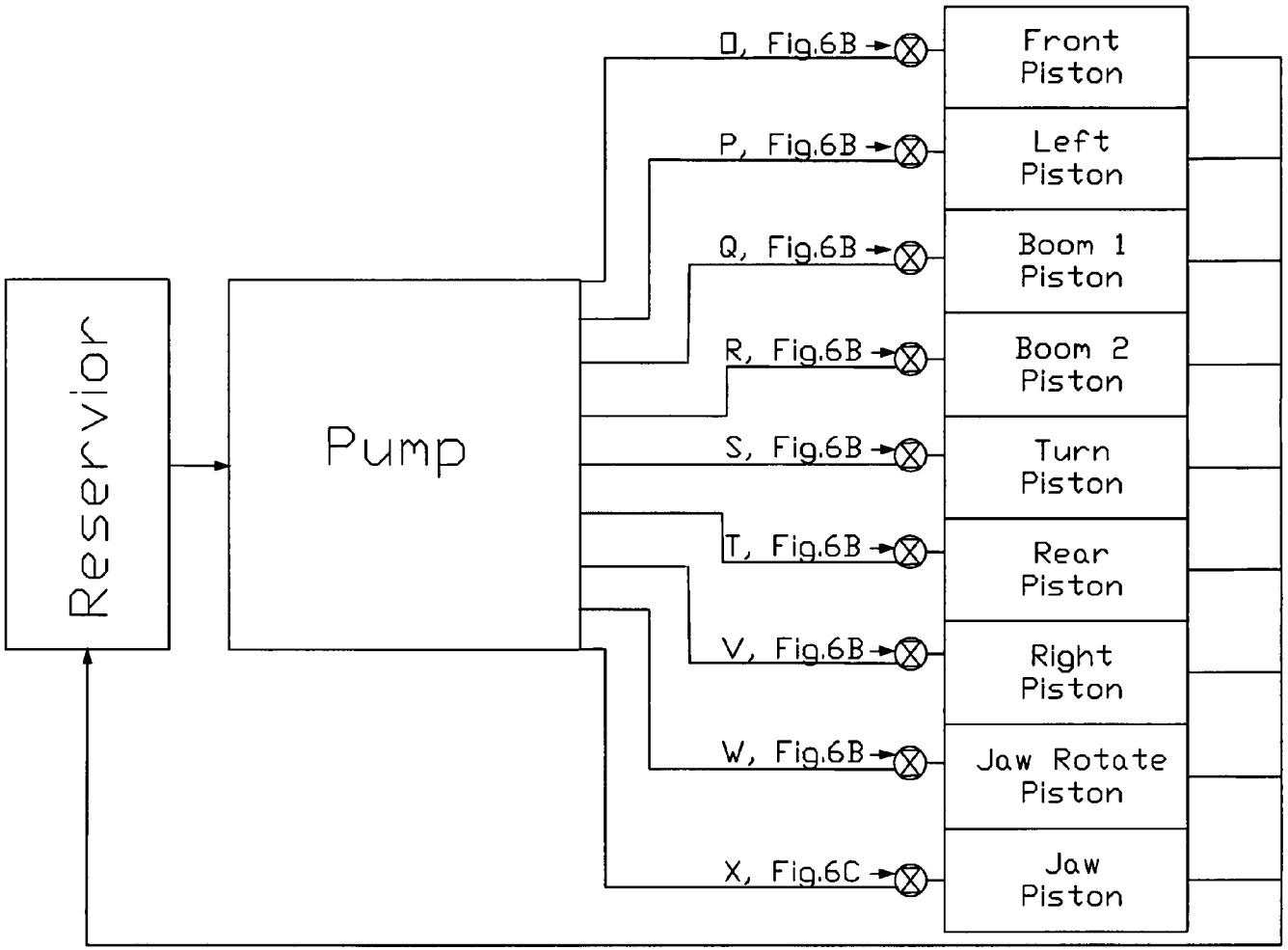

FIG. 5 is an enlarged view of the grapple 55. The grapple 55 includes a pair of jaws 76A, 76B that are coupled to one end of a rotation element 80. The rotation element 80 may includes a plurality of hoses that are associated with the switches 19, 20, 21, 23. The rotation element 80 may rotate the grapple relative to the free end of the end boom element 71 and in accord with a control signal produced by switch 19. The rotation element 80 may also tilt the jaws and open or close the jaws in accordance with input control signals produced by the associated switches.

FIGS. 6A through 6D are schematic views of a control head 90 that connects to the floating transceiver 41 via cable 42. A power supply 120 is either provided in way of a generator or battery source aboard the floating transceiver 41. Alternatively, the power supply 120 may be provided in the control box 90. A power distribution point such as a panel, box or board 121 comprises a plurality of connectors, labeled X1 through X4. These connectors accept power from the power supply and thereafter distribute the power to the associated logic circuits, switches, valves, and pump.

The power distribution board 121 routes power to a relay 122 that operates as an emergency stop switch to cut power to the various hydraulic valves and pump in the event of an emergency. This relay 122 opens to prevent power from flowing to the valves when switch 21 is activated. The opening of the relay 122 prevents any operation of any of the remote disposal unit 61.

Power from the relay 122 is directed to a plurality of pulse width modulators (PWM) 124, 125, 126, 128. These modulators receive control signals from a decoder 129 to produce control signals for the various valves that direct a direction of fluid flowing through the various pistons shown in FIG. 6D. A relay 123 also receives signals that are relayed to the PWMs for controlling the various states of the valves. That is the relay 123 turns the various valves on and off; whilst the output signals from the PWMs to the valves control the direction of fluid, amount and duration of fluid flow through each piston. The relay 123 also provides power to a horn to signal the start up of the signal. The horn may be arranged on the floating transceiver. The connectors, X1 through X4, accepts power from the power supply and thereafter distributes the power to the associated logic circuits, switches, valves, and pump. First and second relays are provided for providing a signal to allow the outriggers to be deployed in a manner to level the remote controlled unit. First and second jaw select relays provide a signal that allows the various functions of the jaws to be realized. A dump valve relay causes the pressure of the pump to be quickly reduced such that a movement of the remote controlled unit may be quickly ceased.

PWMs 124, 125 control the functions of the leveling of the base of the remote disposal unit 61 through pistons 64A through 64D. Control of the boom 69 is also provided by the control signals produce by PWM 124. The various PWMs receive remote control signals and processing them into signals to be used by the bi-directional valves that control the various functions associated with the receiver. PWMs 126, 128 provides control signals for actuating the boom and its respective functions. A receiver 130 is coupled to an antenna on the floating transceiver unit and receives signals from the transmitter of the remote controller. Decoder 129 receives control signals that are produced by the various switches of FIG. 2A. These control signals are processed to convert them into signals for controlling the relays and PMWs for controlling the valves. The receiver is coupled to an antenna that is located on the surface of the body of water. The receiver receives a signal that is transmitted from the remote controller and relays this signal to the decoder for signal processing. A waterproof connector is supplied in a side of the waterproof housing that surrounds the receiver assembly. An antenna is coupled to the waterproof connector via a signal cable that includes a complementary connector that mates with the waterproof connector in the side of the waterproof housing.

Now referring to FIGS. 7A through 7F which depict the ordnance disposal basket 25. Basket 25 comprises sides and an end formed from steel mesh. This is particularly useful in preventing destruction of the basket 25 should ordnance 100 prematurely detonate. The basket includes a fixed bail 400 formed of rigid material such as steel. Self-locking hatches 401 secure a spring loaded entry door 402 via couplers 404. A rigid floatation cylinder 408 receives pressurized air from compressed air cylinders 406. A pressure relief valve 407 assures that the basket is raised to the surface 300 in a uniform manner.

Figure 7A:
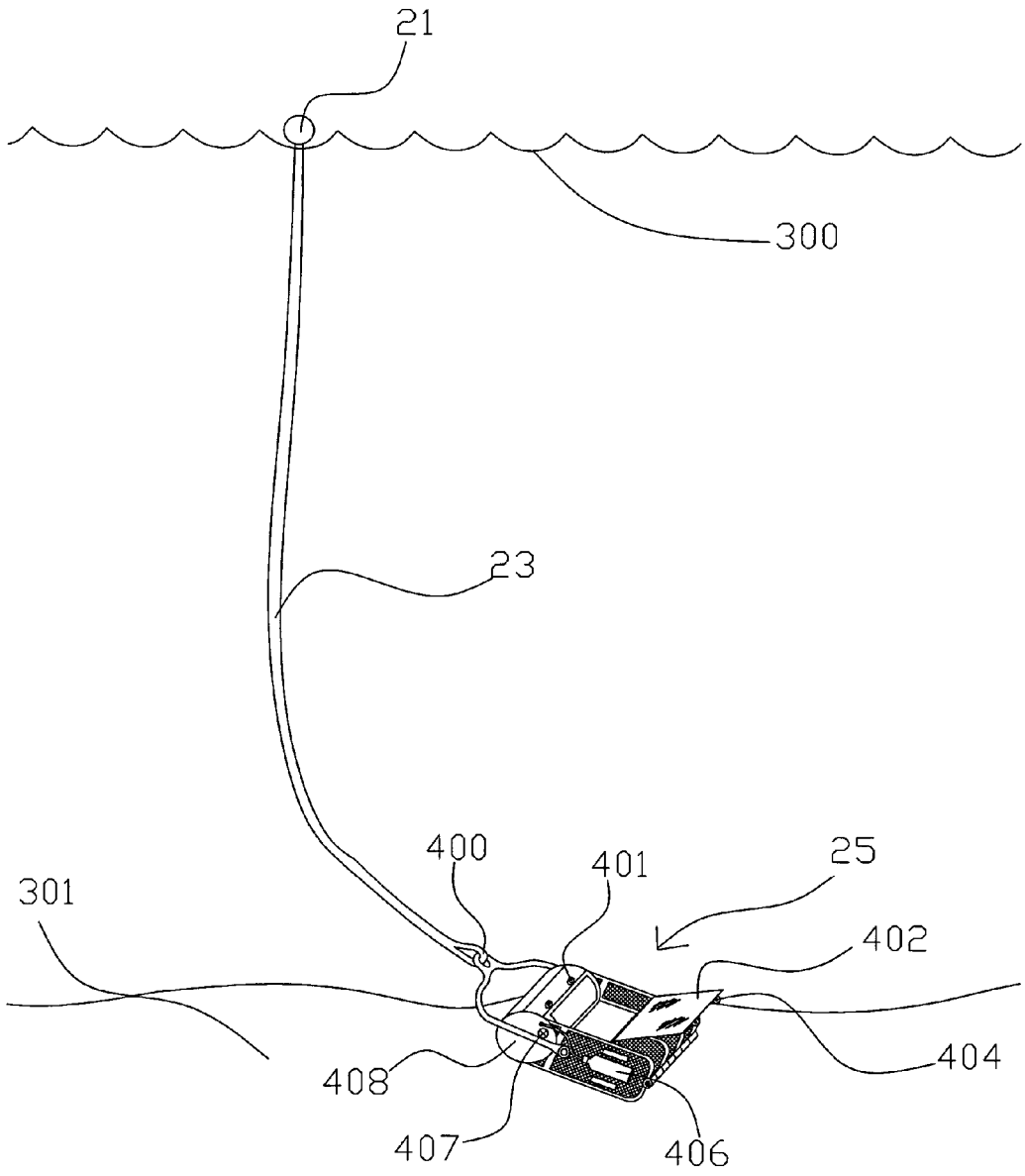
FIGS. 7A-7F depict perspective views of the recovery basket in various positions.
Figure 7B:
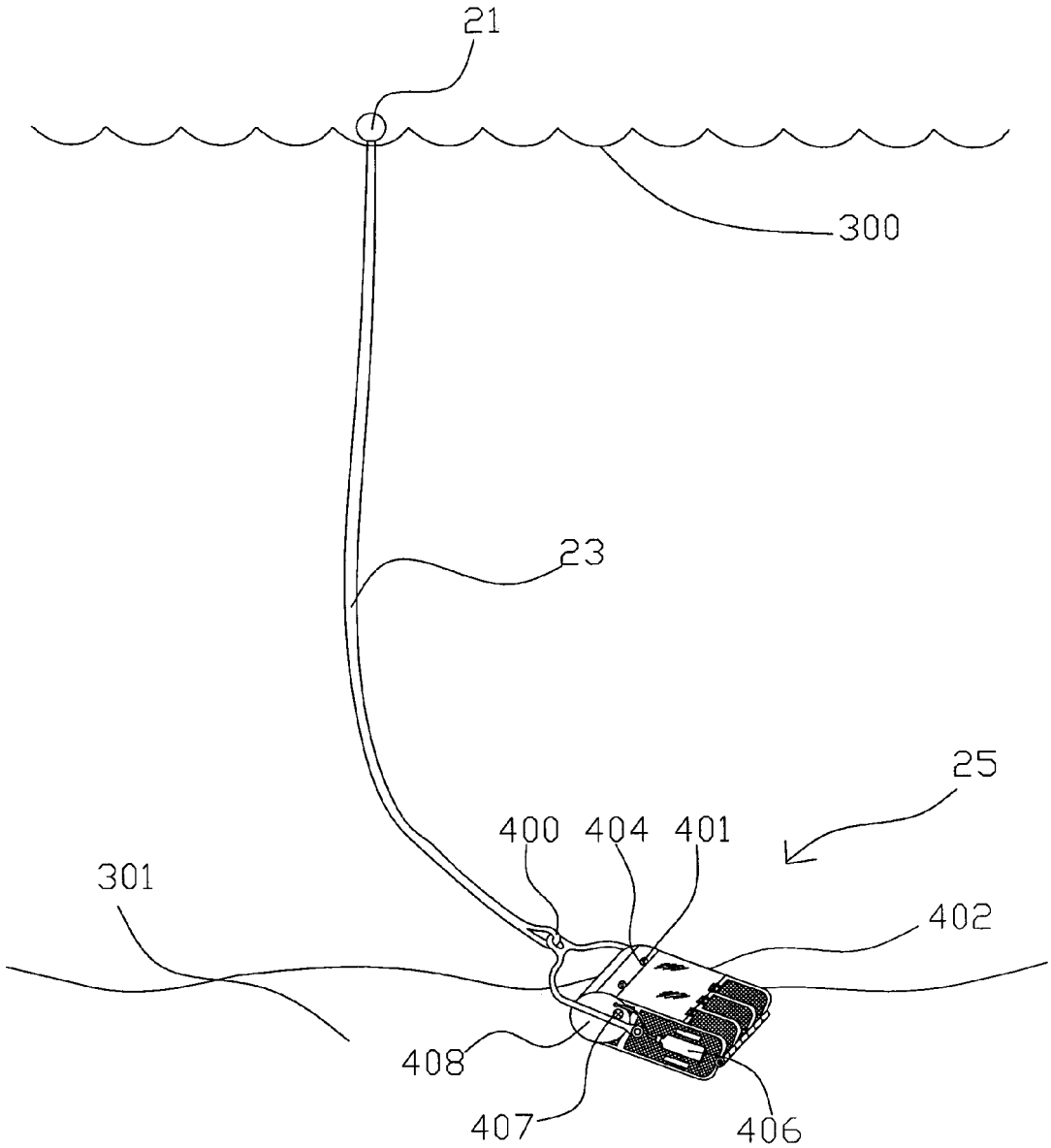
Figure 7C:
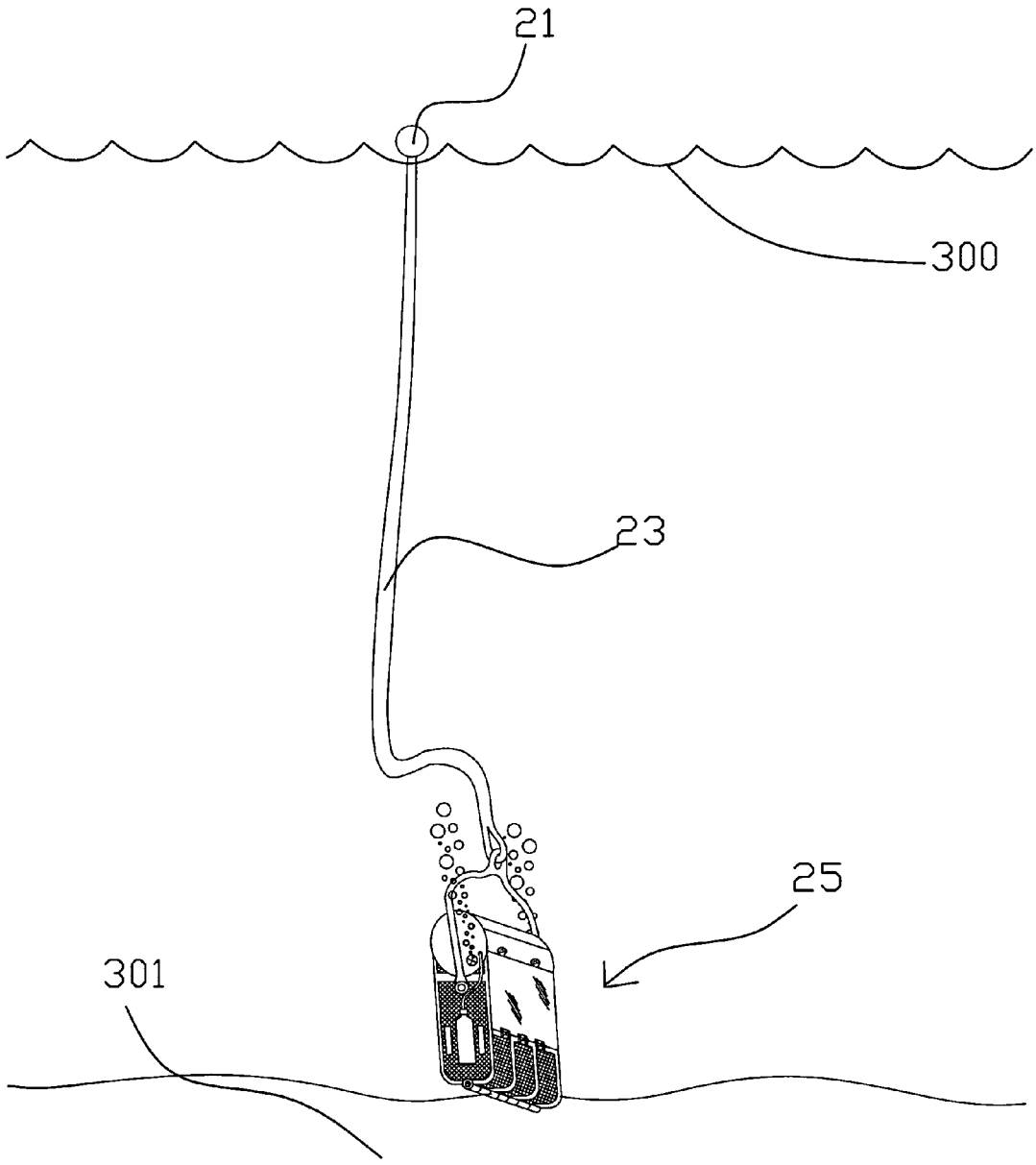
Figure 7D:
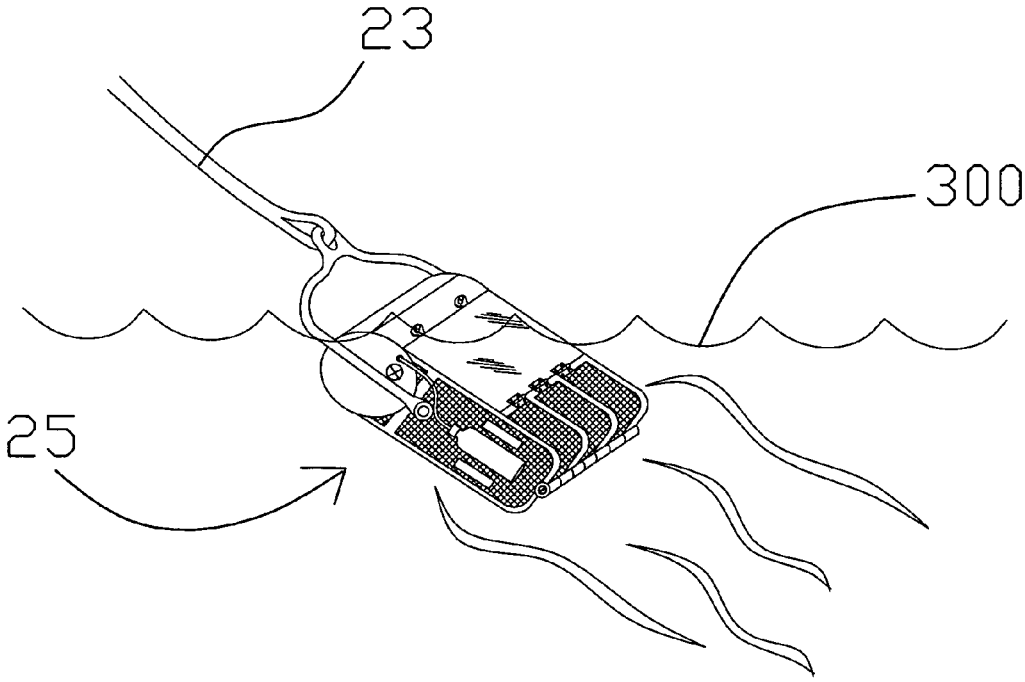
Figure 7E:
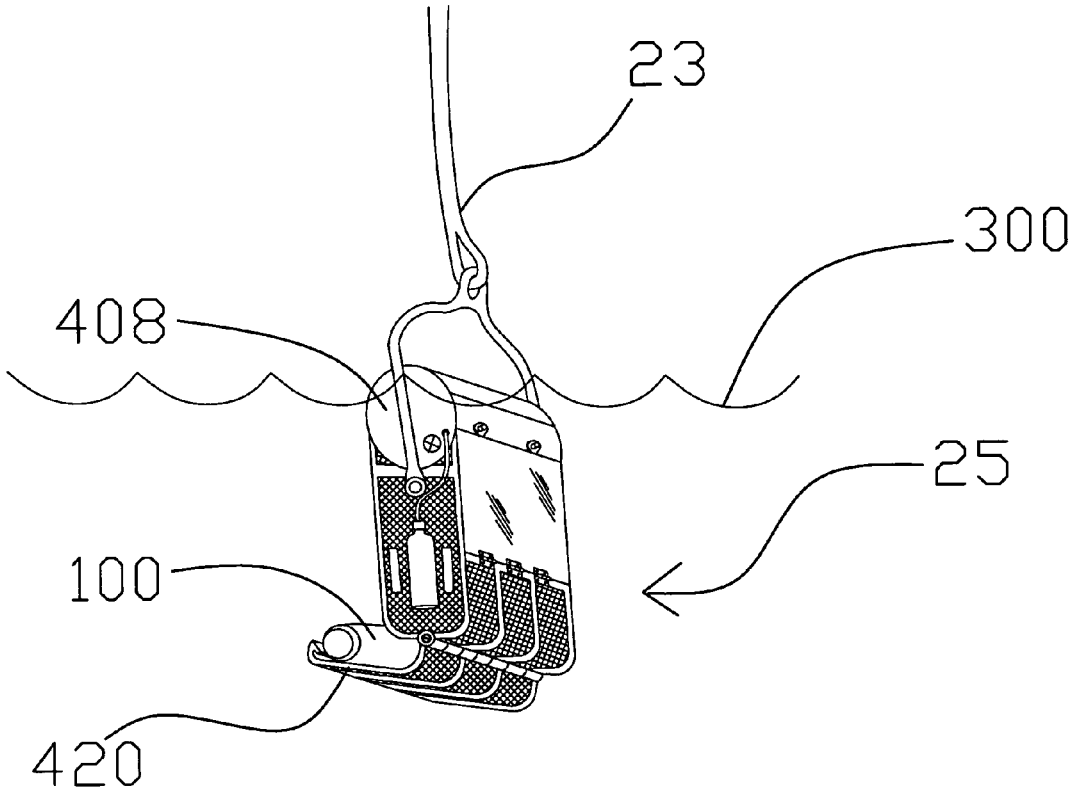
Figure 7F:
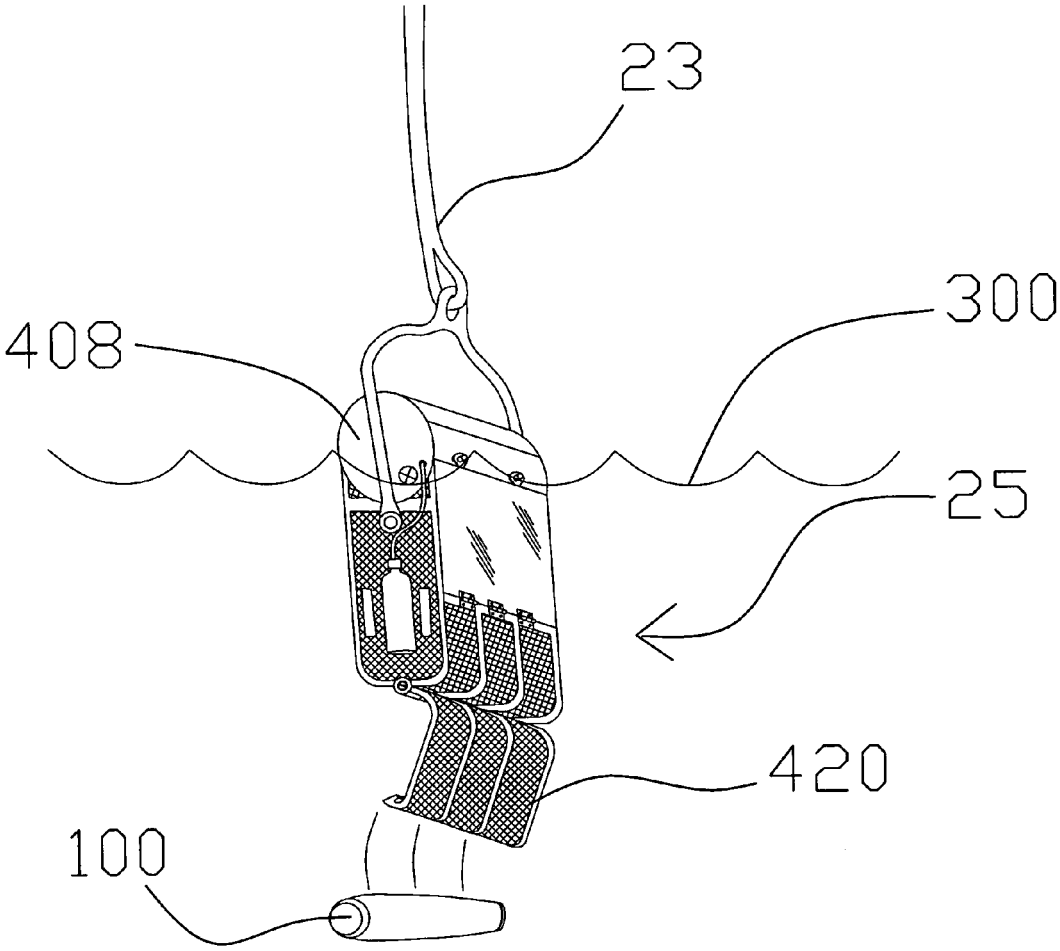

As shown in FIG. 7A, the basket 25 is initially deposited onto the bottom 301 of the body of water with door 402 in an open position. Ordnance 100 is loaded into basket 25 and door 402 is closed. Sonic valves connect between compressed air cylinders 406 such that they are actuated to cause air to flow from the cylinders 406 into cylinder 408. This in turn causes the front of the basket 25 to be raised from the bottom of the water 301, as shown in FIG. 7C. Either the float 21 or the cable tether 23 is caught and the basket 25 is towed as shown in FIG. 7D. When the basket reaches a predetermined dumping area, a second door 420 is opened to dump ordnance 100 from the basket. As ordnance 100 is dumped, the cylinder 408 assumes a higher place on the water surface as shown in FIG. 7F.

While the invention has been described with respect to preferred embodiments, it is intended that all matter contained in the above description or shown in the accompanying drawings shall be interpreted as illustrative and not in limiting sense. From the above disclosure of the general principles of the present invention and the preceding detailed description, those skilled in the art will readily comprehend the various modifications to which the present invention is susceptible. Therefore, the scope of the invention should be limited only by the following claims and equivalents thereof.

I claim:

1. An underwater recovery system for disposing of unexploded ordnance comprising:

a wireless remote controller having a plurality of switches for creating control signals, said remote control including a power supply, and a first transceiver that transmits the control signals to open and close a plurality of valves and receives live video feed;

a fluid actuated grapple including a pair of jaws and arranged at an end of a fluid actuated boom, said grapple including a plurality of pistons arranged to cause the pair of jaws to open and close, tilt up and down, and twist right and left;

video cameras providing the live video feed to the wireless remote controller;

a plurality of hoses connected to the plurality of pistons such that said pistons may be extended or retracted to control a direction of movement and orientation of the fluid actuated grapple to grip an unexploded ordnance;

a pump connected between a fluid reservoir and the plurality of pistons for providing fluid pressure to extend and retract said pistons;

a control head comprising said plurality of valves and further including a floating transceiver coupled to said control head via a cable for receiving at least said control signals to open and close the plurality of valves to vary the fluid pressure in each hose such that the pistons are independently extended and retracted by changing a position of a respective switch of the plurality of switches on the remote controller;

a power source connected to said pump and the control head for providing power thereto for operating each; and, an incompressible fluid that flows through the fluid hoses.

2. The system of claim 1 further including a float including a receiver repeater box tethered to the fluid actuated grapple and floating on a surface of water there above.

3. The system of claim 1 further comprising a submergible ordnance recovery basket capable of holding unexploded ordnance, said submergible ordnance recover basket being tethered to a surface buoy by a fixed bail and being comprised of:

a wire mesh ordnance receptacle with a spring loaded entry door for ordnance on one side and a hinged prop door on an opposite side;

a rigid floatation cylinder comprising self locking latches and an armor kick plate; and compressed air cylinders on opposite sides of the wire mesh ordnance receptacle for feeding air into the cylinder via connective tubes with attached sonic valves located in line with the tubes such that compressed air may be directed into the rigid floatation cylinder to cause the submergible ordnance recovery basket to be raised to a surface of a body of water when a load of ordnance is deposited into the wire mesh ordnance receptacle.

4. The submergible ordnance recovery basket of claim 3 wherein said rigid floatation cylinder further comprises automatic pressure relief valves on both sides of the rigid floatation cylinder to ensure that the submergible ordnance recovery basket does not rapidly rise to the surface of the body of water and cause a premature detonation of the unexploded ordnance.

5. The system of claim 1 wherein the fluid actuated grapple includes waterproof housing that surrounds the pump and the control head.

6. The system of claim 1 further comprising sensors for determining a distance relationship between unexploded ordnance and said grapple.

7. The system of claim 6 wherein said sensors comprise cameras that provide live video feeds to the remote controller.

8. The system of claim 1 wherein said fluid actuated boom includes two ballast tubes arranged on opposite sides thereof for providing stability to the fluid actuated grapple.

9. An underwater recovery system system for disposing of unexploded ordnance comprising:

a wireless remote controller having a plurality of switches for creating control signals, said remote control including a power supply, and a first transceiver that transmits the control signals to open and close a plurality of valves and receives live video feed;

a fluid actuated grapple including a pair of jaws and arranged at an end of a fluid actuated boom, said grapple including a plurality of pistons arranged to cause the pair of jaws to open and close, tilt up and down, and twist right and left;

video cameras providing live video feed to the wireless remote controller;

a plurality of hoses connected to the plurality of pistons such that said pistons may be extended or retracted to control a direction of movement and orientation of the fluid actuated grapple to grip an unexploded ordnance;

a pump connected between a fluid reservoir and the plurality of pistons for providing fluid pressure to extend and retract said pistons;

a control head comprising said plurality of valves and further including a floating transceiver coupled to said control head via a cable for receiving at least said control signals to open and close the plurality of valves to vary the fluid pressure in each hose such that the pistons are independently extended and retracted by changing a position of a respective switch of the plurality of switches on the remote controller;

a power source connected to said pump and the control head for providing power thereto for operating each;

an incompressible fluid that flows through the fluid hoses;

a float including the floating transceiver that includes a receiver repeater box tethered to the fluid actuated grapple and floating on a surface of water there above;

a submergible ordnance recovery basket capable of holding unexploded ordnance, said submergible ordnance recover basket being tethered to a surface buoy by a fixed bail and being comprised of a wire mesh ordnance receptacle with a spring loaded entry door for ordnance on one side and a hinged prop door on an opposite side, a rigid floatation cylinder comprises self locking latches and an armor kick plate, and compressed air cylinders are arranged on opposite sides of the wire mesh ordnance receptacle for feeding air into the cylinder via connective tubes with attached sonic valves located in line with the tubes such that compressed air may be directed into the rigid floatation cylinder to cause the submergible ordnance recovery basket to be raised to a surface of a body of water when a load of ordnance is deposited into the wire mesh ordnance receptacle.

10. The submergible ordnance recovery basket of claim 9 wherein said rigid floatation cylinder further comprises automatic pressure relief valves on both sides of the rigid floatation cylinder to ensure that the submergible ordnance recovery basket does not rapidly rise to the surface of the body of water and cause a premature detonation of the unexploded ordnance.

11. The system of claim 9 wherein the fluid actuated grapple includes waterproof housing that surrounds the pump and the control head.

12. The system of claim 9 further comprising sensors for determining a distance relationship between unexploded ordnance and said grapple.

13. The system of claim 12 wherein said sensors comprise cameras that provide live video feeds to the remote controller.

14. The system of claim 9 wherein said fluid actuated boom includes two ballast tubes arranged on opposite sides thereof for providing stability to the fluid actuated grapple.

15. A method for removing underwater unexploded ordnance, comprising the steps of:

providing a system for disposing of unexploded ordnance comprising a wireless remote controller having a plurality of switches for creating control signals, said remote control including a power supply, and a first transceiver that transmits the control signals to open and close a plurality of valves and receives live video feed, a fluid actuated grapple including a pair of jaws and arranged at an end of a fluid actuated boom, said grapple including a plurality of pistons arranged to cause the pair of jaws to open and close, tilt up and down, and twist right and left, video cameras providing live video feed a plurality of hoses connected to the plurality of pistons such that said pistons may be extended or retracted to control a direction of movement and orientation of the fluid actuated grapple to grip an unexploded ordnance, a pump connected between a fluid reservoir and the plurality of pistons for providing fluid pressure to extend and retract said pistons, a control head comprising said valves and further including a transceiver for receiving at least said control signals to open and close the plurality of valves to vary the fluid pressure in each hose such that the pistons are independently extended and retracted by changing a position of a respective switch of the plurality of switches on the remote controller, a power source connected to said pump and the control head for providing power thereto for operating each and, an incompressible fluid that flows through the fluid hoses;

lowering the fluid actuated grapple to a bottom of a body of water;

viewing the bottom of the body of water via a live video feed relayed back to the remote controller;

selecting a desired ordnance for retrieval;

manipulating the remote controller to cause the fluid actuated grapple to grasp the desired ordnance; and, lifting the ordnance from the bottom of the body of water.

16. The method of claim 15 further comprising:

depositing the ordnance into a recovery basket; and, raising the recovery basket to a surface of the body of water.

17. The method of claim 16 further including:

closing an ordnance entry door on the recovery basket prior to raising the basket to the surface of the body of water.

18. The method of claim 16 further comprising:

remotely actuating valves on the recovery basket to cause compressed air to flow into a floatation cylinder thereby causing the recovery basket to be raised to the surface of the water.

* * * * *